US006303283B1

(12) United States Patent
Klingman et al.

(10) Patent No.: US 6,303,283 B1
(45) Date of Patent: Oct. 16, 2001

(54) POST SENSITIZATION USE OF IODIDE IN SILVER CHLORIDE EMULSION SENSITIZATION

(75) Inventors: Karen J. Klingman, Pittsford; Susan K. Mroczek, Webster, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/606,697

(22) Filed: Jun. 29, 2000

Related U.S. Application Data

(60) Division of application No. 09/234,171, filed on Jan. 19, 1999, now Pat. No. 6,083,679, which is a continuation-in-part of application No. 08/929,699, filed on Sep. 15, 1997, now abandoned.

(51) Int. Cl.[7] ..... G03C 1/035

(52) U.S. Cl. ..... 430/567

(58) Field of Search ..... 430/567, 569

(56) References Cited

U.S. PATENT DOCUMENTS 5,496,689 * 3/1996 Ogawa ..... 430/505
5,691,119 * 11/1997 Mydlarz et al. ..... 430/363

* cited by examiner

*Primary Examiner*—John A. McPherson
(74) *Attorney, Agent, or Firm*—Paul A. Leipold

(57) ABSTRACT

The invention relates to a method of forming an emulsion comprising providing a silver chloride emulsion, said emulsion comprising silver chloride grains having a grain volume of 0.001 $\mu m^3$ to 2.2 $\mu m^3$, adding chemical and spectral sensitizing materials, heating said emulsion to sensitize said grains, cooling said emulsion, and then bringing said emulsion into contact with iodide and bromide.

4 Claims, No Drawings

POST SENSITIZATION USE OF IODIDE IN SILVER CHLORIDE EMULSION SENSITIZATION

CROSS-REFERENCE TO RELATED APPLICATIONS

This is a Divisional of application Ser. No. 09/234,171 filed Jan. 19, 1999 issued as U.S. Pat. No. 6,083,679, which was a continuation-in-part of application Ser. No. 08/929,699 filed Sep. 15, 1997 now abandoned entitled "POST SENSITIZATION USE OF IODIDE IN SILVER CHLORIDE CUBIC EMULSION SENSITIZATION" by Karen J. Klingman et al.

FIELD OF THE INVENTION

This invention relates to improved emulsions. It particularly relates to improved silver chloride emulsions for color print film.

BACKGROUND OF THE INVENTION

In color print films, particularly those utilized for projection of motion pictures, there is a continuing need for an improvement in grain. Such films as they are projected to enormous size in comparison with the size of the image on the film require a very fine grain to achieve a desirable projection quality.

PROBLEM TO BE SOLVED BY THE INVENTION

There is a continuing need for improvement in graininess in projected images of color print film. There is also a continuing need for improved speed of the emulsions without using larger silver halide grains which will result in increased grain in the projected images of the film.

SUMMARY OF THE INVENTION

It is an object of the invention to overcome disadvantages of prior photographic elements.

It is another object of the invention to provide color print film having reduced grain in projected images.

It is another object of the invention to provide finer grain print film that has higher speed for exposure.

These and other objects of the invention generally are accomplished by a method of forming an emulsion comprising providing a silver chloride emulsion, said emulsion comprising silver chloride grain having a grain volume of 0.001 $\mu m^3$ to 2.2 $\mu m^3$, adding chemical and spectral sensitizing materials, heating said emulsion to sensitize, cooling said emulsion, and then bringing the sensitized emulsion into contact with iodide and bromide.

In another embodiment of the invention there is formed a photographic element comprising at least one layer comprising silver chloride grains having on their surface between 0.0005 and 0.002 mol I/mol Ag and 0.005 and 0.05 mol Br/mol Ag.

ADVANTAGEOUS EFFECT OF THE INVENTION

The invention provides improved motion picture color print film that has a fine grain image when projected. It particularly provides a finer grain projected image from the blue sensitive layer.

DETAILED DESCRIPTION OF THE INVENTION

The invention has numerous advantages over prior practice in the art. The invention provides projection films that have a fine grain image. Further, these films are of higher speed, allowing lower light exposure of the film. The emulsion forming technique of the invention produces a lower fog emulsion, thereby resulting in greater exposure latitude of the print film. Further, it has surprisingly been found that the films formed with grains produced by the invention wherein they have been formed from emulsions treated with iodide and bromide after finishing are robust in development allowing a wider latitude of developing solution chemistry to produce a satisfactory image. The emulsions of the invention further are formed by a technique that is robust, reliable, and does not require the addition of chemicals that are deleterious to the film elements. The emulsions formed by the method of the invention find their preferred use in the blue-sensitive layer of motion picture color print film. However, they may be utilized in other materials that are formed with silver chloride emulsions such as color paper. Further, particularly with the use of tabular emulsions, it could find use in color negative films and color intermediate films.

The invention emulsions find their preferred use in the blue-sensitive layer of a color print film. There is a need for greater speed and grain size in the print film's blue-sensitive layer because, as is well known in the trade, the reproduction system results in low energies in the blue wavelength region, as the masking dyes in the negative and printer light source limit blue wavelength exposure. However, it is not possible to increase the grain size significantly, as this will result in graininess of the film being increased. Therefore, there is a desire to make the grains faster, but the same or smaller size. Generally, the grains of the color films for the invention have a cubic edge length of between 0.1 $\mu m$ and 1.0 $\mu m$ for best balance of high speed and low graininess of the developed film.

The grain volume of the silver chloride emulsions of the invention is generally between 0.001 and 2.2 $\mu m^3$. A preferred grain volume for the preferred cubic silver chloride grains is between 0.14 and 0.5 $\mu m^3$.

The emulsion of the invention may be any silver chloride emulsion that results in good image quality of the photographic element. Generally, it is possible that the silver chloride emulsion is formed with up to about 5 percent of iodide and bromide formed in the grain. The grain is generally washed prior to the invention treatment after sensitization with bromide and iodide. It has been found preferred to utilize an emulsion of 100 percent or one consisting essentially of 100 percent silver chloride grain, as such grain is more rapidly developable, as the addition of iodide and bromide into the grain during emulsion formation provides increased difficulty in formation and results in a less robust manufacturing process as more materials must be precisely controlled. The silver chloride grains may be suitable morphology. Suitable are tabular and cubo-octohedral grains. Preferred are cubic grains, as these have good photographic properties and low granularity.

In the method of the invention the chemical and spectral sensitization is carried out in a conventional manner in the art.

The emulsion finishing method of the invention may be carried out using any suitable sensitizing dye. Suitable for the invention are the cyanine sensitizing dyes. The cyanine dyes have the general structure as follows:

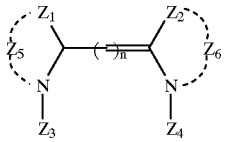

wherein $Z_1$ and $Z_2$ are independently selected from N—R, O, S, and R is a lower alkyl, N=1, 3, or 5 if n>1, then center C may be substituted with lower alkyl, $Z_5$ and $Z_6$ represent atoms sufficient to complete a substituted or unsubstituted 5-membered ring, it may be saturated or unsaturated and may have a substituted or unsubstituted benzene or naphthaline fused onto it, $Z_3$ or $Z_4$ may be sulfoalkyl, carboxyalkyl.

Any of the alkyl groups described above include cycloalkyl. Examples of any of the alkyl groups mentioned above are methyl, ethyl, propyl, isopropyl, butyl, isobutyl, t-butyl, pentyl, hexyl, octyl, 2-ethylhexyl, and the like. Particular cycloalkyl groups can be cyclopentyl, cyclohexyl, 4-methylcyclohexyl, and the like. Alkenyl groups can be vinyl, 1-propenyl, 1-butenyl, 2-butenyl, and the like. Aryl groups can be phenyl, naphthyl, styryl, and the like. Aralkyl groups (which are a type of substituted alkyl) can be benzyl, phenethyl, and the like. Useful substituents on any of the foregoing or other groups disclosed (including substituents on $Z_5$ and $Z_6$) include halogen, alkyl (particularly lower alkyl), alkoxy, acyl, alkoxycarbonyl, aminocarbonyl, carbonamido, carboxy, sulfamoyl, sulfonamido, sulfo, nitro, hydroxy, amino, cyano, trifluoromethyl, and the like. Any of the foregoing (where possible) may be substituted or unsubstituted.

Examples of suitable dyes are

BDS-1

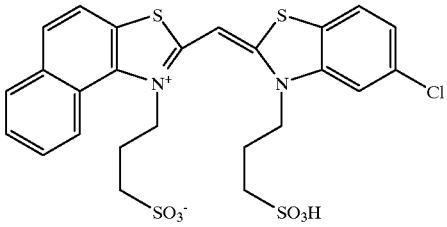

BDS-2

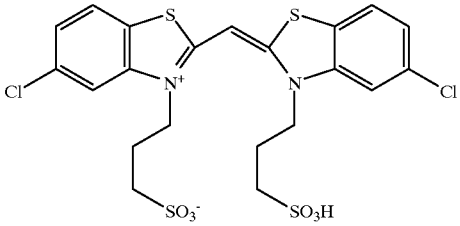

BDS-3

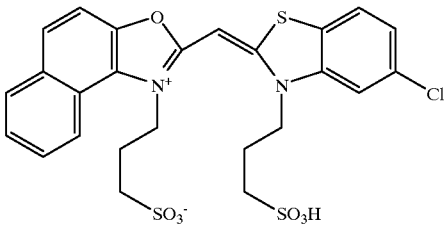

-continued

GSD-1

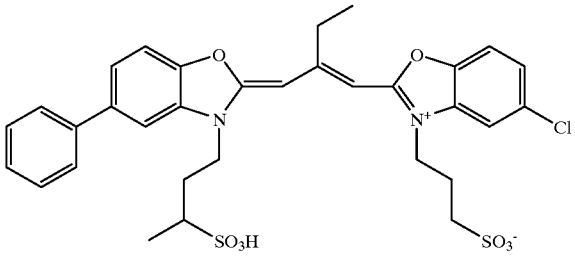

GSD-2

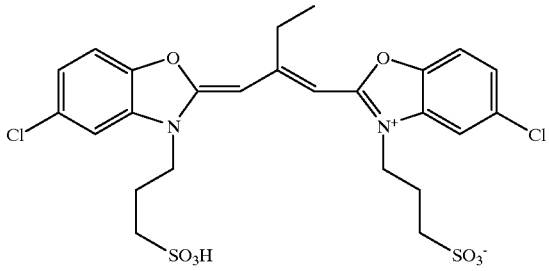

GSD-4

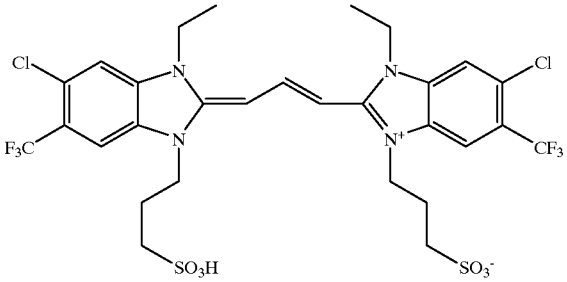

RSD-1

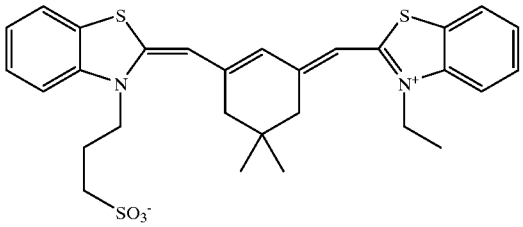

RSD-2

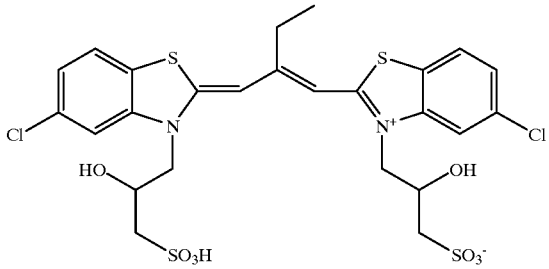

-continued

RSD-3

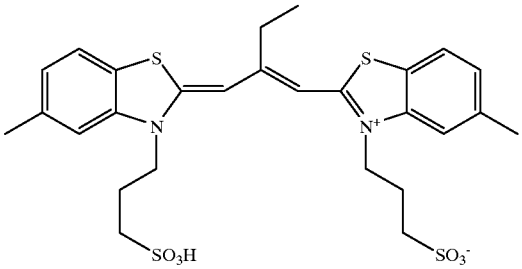

RSD-4

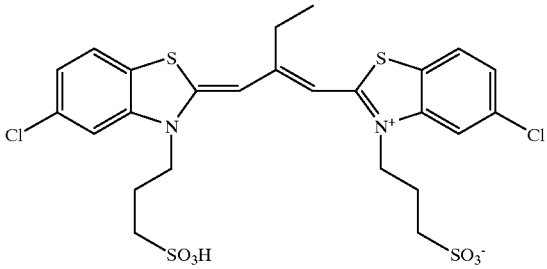

Preferred dyes are the blue cyanine dyes. The most preferred are the cyanines of Structure I:

Dye I

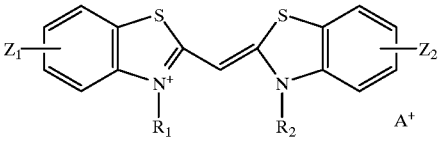

Where $Z_1$ is phenyl, pyrrole, or a fused benzene ring; $Z_2$ is phenyl, pyrrole or halogen, $R_1$ and $R_2$ are acid substituted alkyl groups, $A^+$ is a counterion.

The most preferred of the Structure I dyes is D1

D1

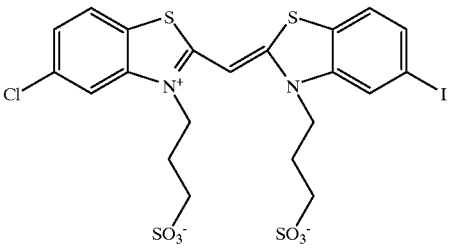

The Structure I dyes may comprise the entire blue sensitizing dye for the method of the invention.

The Structure I dyes may be combined in an amount up to 60 weight percent of the two dyes with dyes of Structure II. It is preferred that between 25 and 50 weight percent of the total dye be Structure II dye for widest latitude blue light sensitivity. Structure II dyes have the Dye II formula:

Dye II

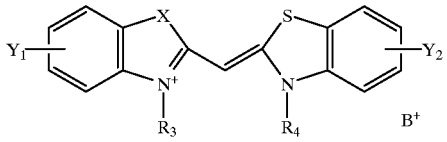

wherein:

$Y_1$ is pyrrole or phenyl, when X is O, then $Y_2$ is a 4,5-benzo substituent;

When X is S, then $Y_2$ is a phenylcarbamoyl or a phenylcarboxamido substituent, $R_3$ and $R_4$ are acid substituted alkyl groups, $B^+$ is a counterion.

The most preferred Dye II dye for combination, particularly with

D1 is D2:

D2

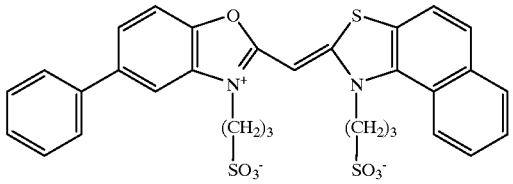

The invention suitably may use antifoggants. Typical of such antifoggants are those disclosed in Section VIII of *Research Disclosure* 36544 published September 1994. Preferred for utilization with the silver chloride emulsions of the invention are the mercaptan antifoggants of the general structure

AF-1

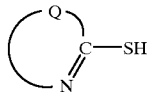

wherein Q represents the atoms necessary to complete a five- or six-membered heterocyclic nucleus. Exemplary preferred heterocyclic nuclei include tetrazoles, triazoles, imidazoles, oxadiazoles, thiadiazoles and benzothiazoles.

In a preferred embodiment, the mercaptan compound has one of the following structures:

AF-Ia

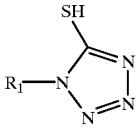

AF-Ib

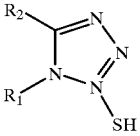

-continued

AF-Ic

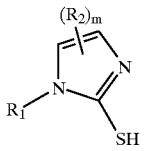

AF-Id

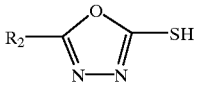

AF-Ie

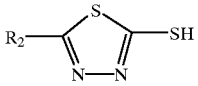

AF-If

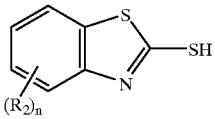

wherein $R_1$ is selected from hydrogen, alkyl, aryl, carbonamido, sulfonamido, alkenyl, cycloalkyl, cycloalkenyl, alkinyl, sulfonyl, sulfinyl, phosphonyl, acyl, carbamoyl, sulfamoyl, amino, alkylamino, anilino, imido, ureido, sulfamoylamino, alkoxycarbonylamino, aryloxycarbonylamino, alkoxycarbonyl, aryloxycarbonyl; $R_2$ is selected from the same substituents as $R_1$ and halogen, alkoxy, aryloxy, siloxy, acyloxy, carbamoyloxy; m=0–2; and n=0–4.

Preferred antifoggants are arylmercaptotetra-zoles of the general formula AF-Ia (RI=aryl). Most preferred antifoggants are 1-(3-acetamido-phenyl)-5-mercaptotetrazole, 1-(3-benzamidophenyl)-5-mercaptotetrazole, 1-(3-(2-hydroxy) benzamidophenyl)-5-mercaptotetrazole, and 1-phenyl-5-mercaptotetrazole for effective fog control without harmful photographic effects.

The chemical sensitization (digestion) can be accomplished by any of a variety of known chemical sensitizing agents such as those described in *Research Disclosure* 37038 of February 1995 in Section XV. The preferred sensitizing agents would be sulfiding agents, sources of gold, combinations of sulfur and gold, or aqueous colloidal gold sulfide because of the ability these agents have to produce sub-stantially higher emulsion speed/sensitivity as compared to the untreated emulsion. The preferred chemical sensitizers of the invention is gold and sulfur sensitization, as it is effective and reliable.

The invention finds its preferred use in color print film. Color print films generally have a layer structure as follows:

| |
|---|
| Layer 7 Overcoat |
| Green Sensitive Layer 5 |
| Interlayer Layer 4 |
| Red Sensitive Layer 3 |
| Interlayer 2 |
| Blue Sensitive Layer 1 |
| Antihilation Layer |
| Support |

The green sensitive layer will comprise a magenta dye forming coupler, as well as a silver halide emulsion that has been green sensitized. The interlayers comprise gelatin and usually scavenger, such as a hydroquinone. The red sensitive layer will comprise a cyan dye forming coupler and a silver halide emulsion that has been sensitized to red. The blue sensitive layer will contain a yellow dye forming coupler and a silver halide emulsion that has been sensitized to blue light. The silver chloride emulsions utilized in the color print films of the invention only have slight native blue sensitivity. The coupler containing layers also may contain materials such as antifoggants, supersensitizer, bacteria stats, stabilizers and other additives which will contribute to photographic performance, storage, or developability. Such materials are well known in the art and have been disclosed in locations such as *Research Disclosure* 38957 of September 1996. There are a variety of well-known couplers for cyan, magenta and yellow dye forming that may be successfully utilized in the invention. Suitable are the couplers disclosed at Section II of *Research Disclosure* 37038 of February 1995. The films also may be provided with magnetic layers to record exposure or other information that may be helpful in processing or reproducing the film.

In finishing of the emulsion of the invention, after addition of the chemical and spectral sensitizing materials, heating takes places to complete the finish. Such heating generally is to a temperature of between about 50 to 70° C. Cooling is then carried out to about 40 degree temperature. The iodide and bromide of the invention are added as an aftertreatment after the heating and cooling of finishing. The cooling generally is to between a temperature of 35 and 45° C.; however, about 40° C. is preferred because the emulsion is easy to control without gelling or further reaction at this temperature. The iodide and bromide brought into contact with the emulsion after cooling, may be simultaneously added or added separately. However, it is preferred that the iodide be added first with the bromide following after several minutes, as this results in higher speed than if the bromide is added simultaneously or before the iodide.

At this time it also is possible that other materials such as antifoggants may be added. Typical of antifoggants are those in Section VII of *Research Disclosure* 38957. Preferred antifoggants are 1-(3-acetamidophenyl)-5-mercaptotetrazole and AF-1a above.

The amount of iodide utilized in the grains of the invention may be 30 any suitable amount that results in increased speed. A suitable amount of iodide generally is between about 0.0005 and 0.005 mol iodide/mol Ag for best speed with minimum fog. The iodide is added to the emulsion as a salt, such as sodium or potassium iodide.

The bromide-utilized in the method of formation of the grains of the invention may be utilized in any suitable amount that results in an emulsion that has low fog. A suitable amount generally comprises between about 0.001 and 0.05 mol Br/mol Ag. The bromide generally is added to the cooled emulsion as a salt, such as sodium or potassium bromide.

The bromide and iodide of the invention are placed in what is believed to be generally a molecular layer on the surface of the grains. By this, it is meant that the bromide and iodide are attached to surface silver halide of the grain and would not penetrate substantially to a depth beyond about 16 Å. As used herein, the term "core" means the entire portion of the grain excepting the surface molecular layers of up to 16 Å.

The following example illustrates the practice of this invention. It is not intended to be exhaustive of all possible variations of the invention. Parts and percentages are by weight unless otherwise indicated.

EXAMPLE

Emulsion Preparation

The emulsion (invention) is precipitated by bringing together NaCl and $AgNO_3$, in the presence of gelatin, antifoamant, dithio-3,6-octane-1,8-diol, and glutaryldiaminophenyldisulfide to form grains of cubic edge length 0.5 μm–0.8 μm, with an aspect ratio of 1.2 or less. After desalting, the emulsion is then chemically and spectrally sensitized by the addition of orthosuccinamidophenyldisulfide, gold(I) bis(1,4,5-trimethyl- 1,2,4-triazolium-3-thiolate)gold(I) fluoroborate, D1 and D2, and sodium thiosulfate followed by a heat cycle.

D1

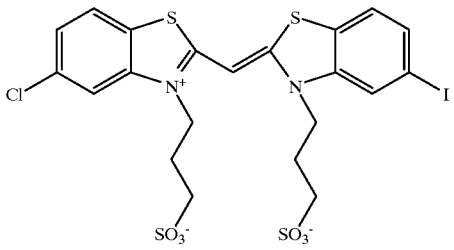

D2

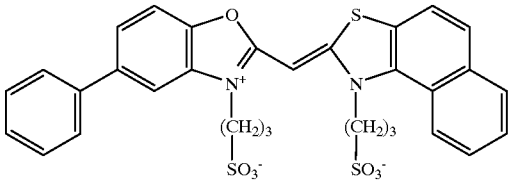

After the heat cycle, these three chemicals are added in any sequence: potassium iodide at 0.0015 mol iodide/mol Ag, 1-(3-acetamidophenyl)-5-mercaptotetrazole at about 70 mg/Ag mol, and potassium bromide 0.005 mol bromide/mol Ag.

Performance

Table I illustrates that the addition of iodide to chemically and spectrally sensitized AgCl cubes without changing grain size provides approximately ½ stop of photographic speed without impacting other photographic performance parameters such as Dmin, contrast, keeping, or reciprocity. The availability of more photographic speed from a given grain size allows the use of smaller grains to achieve high speeds.

TABLE I

Features of Invention

| Feature | Control Sample | Invention |
|---|---|---|
| Grain size | CEL#1 | CEL#1 |
| RMS Granularity | 1.0 | 1.0 |
| Speed | 100 | 110–120 |
| Dmin | 0 | 0 |
| Contrast | 1.0 | 1.0 |
| short-term LIK | <0.01 logE speed change per 1.0 log 10(minutes) | <0.01 logE speed change per 1.0 log10(minutes) |
| raw stock keeping | no change 3months/55F | no change 3months/55F |

NOTE: CEL#1 = cubic edge length between 0.4 μm–0.75 μm

Experimental Procedure

To illustrate that the invention provides increased sensitometric speed without changing other photographic performance parameters, the invention and control were each evaluated in a multilayer film, as silver in the blue-sensitive layer, in format shown in Table II. The control sample was prepared by a method equal to that used for preparing the invention, except that the potassium iodide was omitted. The remainder of the materials were as in conventional print film. Film samples thus coated were given white light exposures and processed in Kodak's ECP-2B process, which is well known in the trade and is documented in Kodak's H-24 manual. Status A densities vs. exposure were measured, and plots of density vs. log exposure provided information to calculate photographic speed (log exposure required to give density=Dref) and contrast (slope of the plot of density vs. log exposure). The results showed an improved film having less graininess in the yellow layer.

TABLE II

Multilayer Coating Format

| | |
|---|---|
| Layer 1 | Antihalation Layer |
| Layer 2 | Blue Sensitive Layer |
| | Gelatin |
| | Silver |
| | Y-1 |
| | Dibutyl phthalate |
| | UV-1 |
| Layer 3 | Interlayer |
| | Gelatin |
| | SC-1 |
| | SF-1 |
| Layer 4 | Red Sensitive Layer |
| | Gelatin |
| | Silver |
| | C-1 |
| | Tritolyl phosphate |
| | Tris(2-ethylhexyl phosphate) |
| | SC-1 |
| Layer 5 | Interlayer |
| | Gelatin |
| | SC-1 |
| | SF-1 |
| Layer 6 | Green Sensitive Layer |
| | Gelatin |
| | Silver |
| | M-1 |
| | Tirtolyl phosphate |
| | SC-1 |
| Layer 7 | Overcoat |

Y-1 =

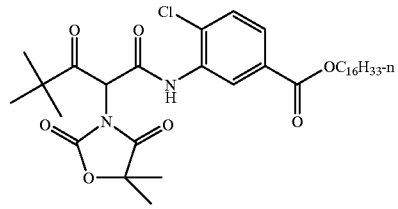

UV-1 =

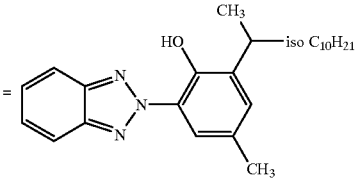

SC-1=1,4-isododecyl hydroquinone

SF-1=

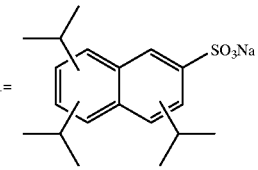

-continued

C-1=

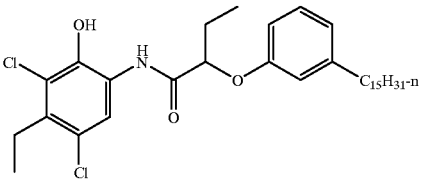

M-1=

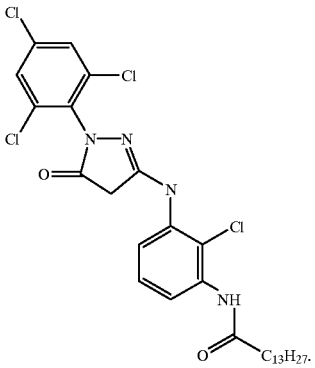

The invention has been described in detail with particular reference to certain preferred embodiments thereof, but it will be understood that variations and modifications can be effected within the spirit and scope of the invention.

What is claimed is:

1. A photographic element comprising at least one layer comprising silver chloride grains having on their surface between 0.0005 and 0.005 mol I/mol Ag and 0.001 and 0.05 mol Br/mol Ag wherein the grain volume of said grains is between 0.14 and 0.5 $\mu m^3$ and said grains consist essentially of silver chloride except within 16 Å of their surface.

2. The element of claim 1 comprising a photographic print film.

3. The element of claim 2 wherein said at least one layer is a yellow dye forming layer.

4. The element of claim 1 wherein said silver chloride grains comprise cubic grains.

* * * * *